US007000778B2

(12) United States Patent
Omori et al.

(10) Patent No.: US 7,000,778 B2
(45) Date of Patent: Feb. 21, 2006

(54) BILL HANDLING MACHINE

(75) Inventors: Yoshiyuki Omori, Nagoya (JP); Minoru Kadowaki, Toyota (JP)

(73) Assignee: Hitachi, Ltd., Tokyo (JP)

( * ) Notice: Subject to any disclaimer, the term of this patent is extended or adjusted under 35 U.S.C. 154(b) by 215 days.

(21) Appl. No.: 10/447,285

(22) Filed: May 29, 2003

(65) Prior Publication Data

US 2004/0011622 A1 Jan. 22, 2004

(30) Foreign Application Priority Data

May 29, 2002 (JP) ..... 2002-154941

(51) Int. Cl.
*B07C 5/00* (2006.01)

(52) U.S. Cl. ..... 209/534; 902/38; 235/379

(58) Field of Classification Search ..... 209/534; 235/379; 700/213, 231, 232; 705/43; 902/8, 902/9, 14, 15, 16, 38; 194/206, 215, 216, 194/217, 302, 350
See application file for complete search history.

(56) References Cited

U.S. PATENT DOCUMENTS 4,649,832 A * 3/1987 Hain et al. ..... 109/24.1
5,777,304 A * 7/1998 Awatsu et al. ..... 235/379
5,864,826 A * 1/1999 Awatsu et al. ..... 705/35

FOREIGN PATENT DOCUMENTS

| | | |
|---|---|---|
| EP | 0 019 191 | 11/1980 |
| EP | 0 905 657 A1 | 3/1999 |
| EP | 1 139 302 A1 | 10/2001 |
| JP | 2000-20783 | 1/2000 |

* cited by examiner

*Primary Examiner*—Donald P. Walsh
*Assistant Examiner*—Mark J. Beauchaine
(74) *Attorney, Agent, or Firm*—McDermott Will & Emery LLP

(57) ABSTRACT

To change a bill storage box for deposit/withdrawal in a bill handling machine to a bill storage box for withdrawal only, a recycling box has conventionally been exchanged with a withdrawal-only box. That is, an extra withdrawal-only box exchanged with a recycling box must be prepared. The present invention provides a bill handling machine processing bills under various condition without preparing an extra bill storage box. The bill handling machine comprises a deposit/withdrawal port, via which bills are deposited or withdrawn, and a plurality of recycling boxes each of which stores bills of each denomination and dispenses deposited and stored bills. An operation of a recycling box, deposit-only box, and withdrawal-only box are set up for each recycling box and operation information on the recycling box is stored in the recycling box for use in checking consistency with the machine to prevent a malfunction in the recycling box.

17 Claims, 9 Drawing Sheets

400

| 401 FRAME NUMBER | 402 BOX TYPE | 403 DENOMINATION INFORMATION | 404 OPERATION INFORMATION |
|---|---|---|---|
| 1 | DEPOSIT | ALL | RJ—A |
| 2 | RECYCLE | TEN-THOUSAND YEN | DEPOSIT ONLY |
| 3 | RECYCLE | THOUSAND YEN | DEPOSIT / WITHDRAWAL |
| 4 | RECYCLE | RESERVED | |
| 5 | WITHDRAWAL | TEN-THOUSAND YEN | |

400

| 401 FRAME NUMBER | 402 BOX TYPE | 403 DENOMINATION INFORMATION | 404 OPERATION INFORMATION |
|---|---|---|---|
| 1 | DEPOSIT | ALL | RJ—A |
| 2 | RECYCLE | TEN-THOUSAND YEN | DEPOSIT ONLY |
| 3 | RECYCLE | THOUSAND YEN | DEPOSIT / WITHDRAWAL |
| 4 | RECYCLE | RESERVED | |
| 5 | WITHDRAWAL | TEN-THOUSAND YEN | |

FIG.5

500

| BOX TYPE | DENOMINATION INFORMATION | | OPERATION INFORMATION |
|---|---|---|---|
| DEPOSIT | BILL | TEN-THOUSAND YEN BILL | |
| | | | |
| | | THOUSAND YEN BILL | |
| | | | |
| | | 10 DOLLAR BILL | |
| | | | |
| | ALL | | — |
| | | | RJ—A |
| | | | RJ—B |
| | | | RJ—C |
| | RESERVED | | |
| RECYCLE | BILL | | DEPOSIT / WITHDRAWAL |
| | | | DEPOSIT ONLY |
| | | | WITHDRAWAL ONLY |
| | RESERVED | | |
| WITHDRAWAL | BILL | | |
| | RESERVED | | |

FIG.6

A 601

| BOX TYPE | DENOMINATION INFORMATION | OPERATION INFORMATION |
|---|---|---|
| DEPOSIT | ALL | RJ—A |

B 602

| BOX TYPE | DENOMINATION INFORMATION | OPERATION INFORMATION |
|---|---|---|
| RECYCLE | TEN-THOUSAND YEN | DEPOSIT ONLY |

C 603

| BOX TYPE | DENOMINATION INFORMATION | OPERATION INFORMATION |
|---|---|---|
| RECYCLE | THOUSAND YEN | DEPOSIT / WITHDRAWAL |

D 604

| BOX TYPE | DENOMINATION INFORMATION | OPERATION INFORMATION |
|---|---|---|
| RECYCLE | RESERVED | |

E 605

| BOX TYPE | DENOMINATION INFORMATION | OPERATION INFORMATION |
|---|---|---|
| WITHDRAWAL | TEN-THOUSAND YEN | |

FIG.11

1101

DENOMINATION INFORMATION INVALID FOR BOX TYPE

| FRAME NUMBER | BOX TYPE | DENOMINATION INFORMATION | OPERATION INFORMATION |
|---|---|---|---|
| 1 | DEPOSIT | ALL | RJ—A |
| 2 | RECYCLE | ALL | DEPOSIT ONLY |
| 3 | RECYCLE | THOUSAND YEN | DEPOSIT / WITHDRAWAL |
| 4 | RECYCLE | RESERVED | |
| 5 | WITHDRAWAL | TEN-THOUSAND YEN | |

1103

1102

BILL HANDLING MACHINE

BACKGROUND OF THE INVENTION

The present invention relates to a bill handling machine that handles bills, and more particularly to an Automated Teller Machine (hereinafter called an ATM) installed in financial institutions such as a bank to execute processing such as deposit, payment, and money transfer in response to a customer's request with a card, receipt paper, and bills as the medium, and to a Bill Recycle Module (hereinafter called a BRM) included in an ATM to recycle deposited bills for withdrawal.

An ATM is required to handle bills stored under various conditions of a country, a region, or a financial institution where it is used. For example, JP-A-2000-20783 discloses a technology for use on an ATM or a BRM for ensuring consistency between bill storage boxes, such as a deposit-only box, a withdrawal-only box, and a recycling box, by providing boxes of uniform size to allow those boxes to be used in any combination and to be added or removed according to the condition.

According to the technology disclosed in JPA-2000-20783, one of the following two may be selected; an ATM or a BRM has deposit-only boxes and withdrawal-only boxes separately, and an ATM or a BRM has recycling box that are used as both deposit-only boxes and withdrawal-only boxes. The former is selected in a case where, for reasons of bill distribution conditions, bill recycling involves a risk of counterfeit bills or a jam condition caused by broken bills. The latter is selected in a case where there is a strong need for making use of cash, such as bills, stored in an ATM or a BRM to save labor in exchanging boxes when a box is short of, or filled with, bills. In addition to a regional reason, boxes may be added or removed depending upon the deposit/withdrawal transaction operation status. For example, although bills are recycled on week days, it is also possible to add withdrawal-only boxes on days or during time zones, such as holidays or a pay day or during a lunch hour, when the withdrawal transaction is supposed to be done more frequently than the deposit transaction.

SUMMARY OF THE INVENTION

However, according to the technology disclosed in JP-A-2000-20783, when the deposit-only boxes, withdrawal-only boxes, or recycling boxes are exchanged during operation to meet the requirement described above (for example, when the operation is changed from the recycle operation to the withdrawal operation), the operator must exchange the recycling box with the withdrawal-only box. That is, the operator must remove a recycling box that is installed on the machine and install a withdrawal-only box provided in a separate place. The problem is that a financial institution must have an extra withdrawal-only box that will replace the recycling box. In view of this, it is an object of the present invention to provide a bill handling machine that handles bills under various condition with no need for an extra bill storage box.

When the operation condition for a recycling box in a bill handling machine is changed in the same manner as that for other boxes, the following problem will develop. That is, because a bill storage box to be used as "withdrawal only" does not accept bills, the operator usually stores rather more bills in that box before setting it in the machine. If "Deposit/Withdrawal" is set for the box in the ATM or BRM, the box accepts bills according to that information. As a result, the bill storage box becomes full soon and the transaction in the bill handling machine stops. This requires maintenance such as the collection of bills. In particular, there is a high possibility that a box is mistakenly inserted when the same-size boxes are used for consistency. Thus, it is another object of the present invention to provide a bill handling machine that prevents bill storage boxes from being inserted mistakenly and that allows an operator to use bill storage boxes as he or she intends.

To achieve the above objects, there is provided a bill handling machine comprising a deposit/withdrawal port via which bills are deposited and withdrawn; and a plurality of recycling boxes each having a function to store bills for each denomination and to dispense deposited and stored bills, wherein the operation of each recycling box may be set to the operation of a recycling box, a deposit-only box, and a withdrawal-only box. In addition, the operation information on a recycle box is stored in the recycle box for checking consistency with the machine to prevent the malfunction of the recycling box.

Other objects, features and advantages of the invention will become apparent from the following description of the embodiments of the invention taken in conjunction with the accompanying drawings.

BRIEF DESCRIPTION OF THE DRAWINGS

FIG. 5 is a diagram showing an example of a condition table.

FIG. 6 is a diagram showing an example of box memory.

FIG. 7 is a flowchart showing the control operation executed by an ATM controller when the power is turned on.

FIG. 11 is a diagram showing an example (1) of a screen displayed on an operator operation unit.

DESCRIPTION OF THE EMBODIMENTS

An embodiment of the present invention will be described with reference to FIGS. 1–12. It is to be understood that the present invention is not limited to the embodiment.

An automated teller machine installed in financial institutions to execute processing such as deposit, payment, money transfer in response to a customer's request with a card, receipt paper, and bills as the medium is called an ATM. A bill recycling module, included in the ATM and having a recycling mechanism that uses deposited bills for withdrawal, is called a BRM. The bill handling machine means an ATM or a BRM.

Figure 1:
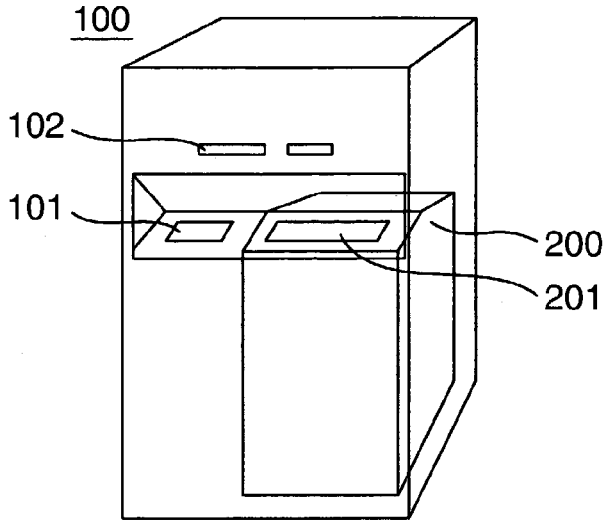
FIG. 1 is an external view of an ATM.

FIG. 1 is a perspective view showing the overview of an ATM 100 installed in a financial institution to execute processing such as cash deposit, payment, and money transfer in response to a customer's request with a card, receipt paper, and bills as the medium. The ATM 100 comprises a customer operation panel 101 such as a touch display panel that has a display unit displaying a guide screen to a customer and receiving an instruction from the customer, a medium slot 102 that receives a customer's card and passbook and returns them as well as receipt paper to the customer, and a shutter-equipped deposit/withdrawal port 201 that receives bills from, and ejects bills to, a customer for deposit/withdrawal processing. The deposit/withdrawal port 201 is connected to a bill recycle module (BRM) 200.

Figure 2:
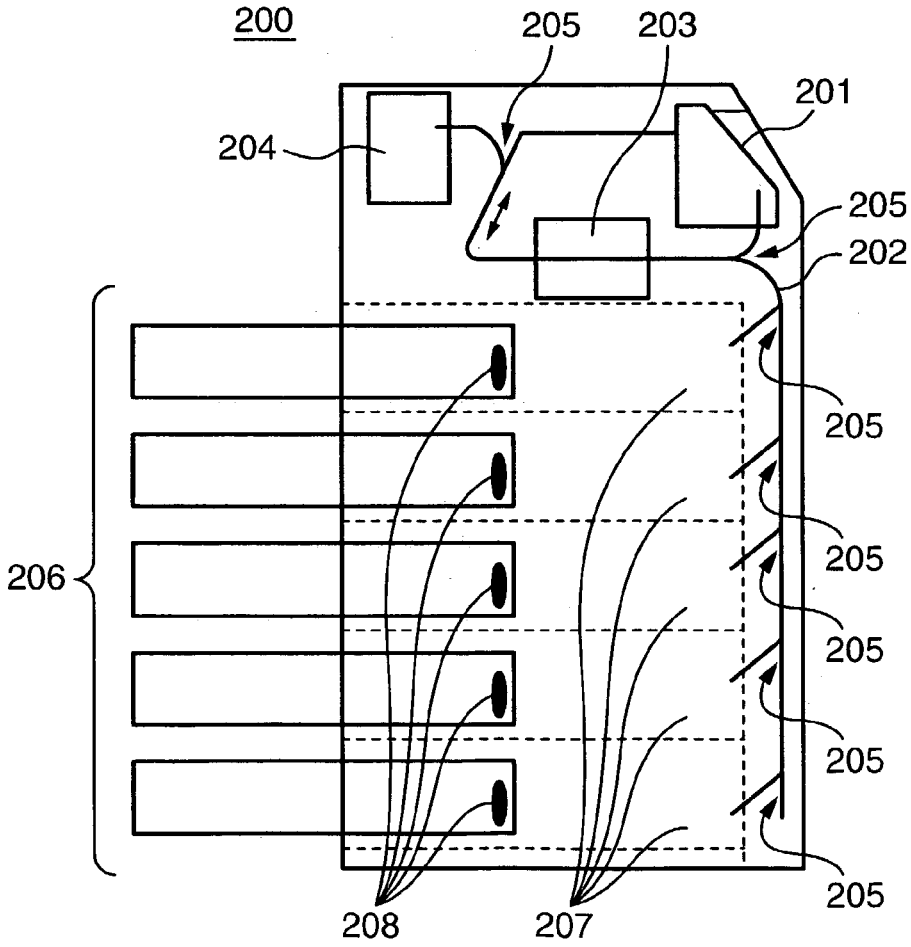
FIG. 2 is a schematic side view of a BRM.

FIG. 2 is a side view showing the internal configuration of the BRM 200. The BRM 200 comprises a deposit/withdrawal port 201, a transport path 202 along which a bill is transported, a bill discrimination unit 203 that optically or magnetically detects the authenticity of a bill, a temporary storage box 204 in which transported bills are stored temporarily, transport switching gates 205 that switch the transport at branch points in the transport path, a plurality of bill storage boxes 206 in which bills are stored, and a plurality of frames 207 on which the bill storage boxes 206 are installed.

There are many types of bill storage boxes 206: recycling box (also called an RB), deposit-only box (also called an AB), withdrawal-only box, and reject box. Those bill storage boxes, similar in shape for consistency, may be exchanged according to the purpose, and bill storage boxes and frames may be added or removed. Each bill storage box 206 has a box memory 208 that allows an operator to change the denominations in use and operation information on the bill storage box via the operator operation unit on a software basis. Each frame 207 has a box memory reader 209 that reads information from the box memory 208 in the bill storage box 206 installed on the frame 207.

Figures 3, 4:
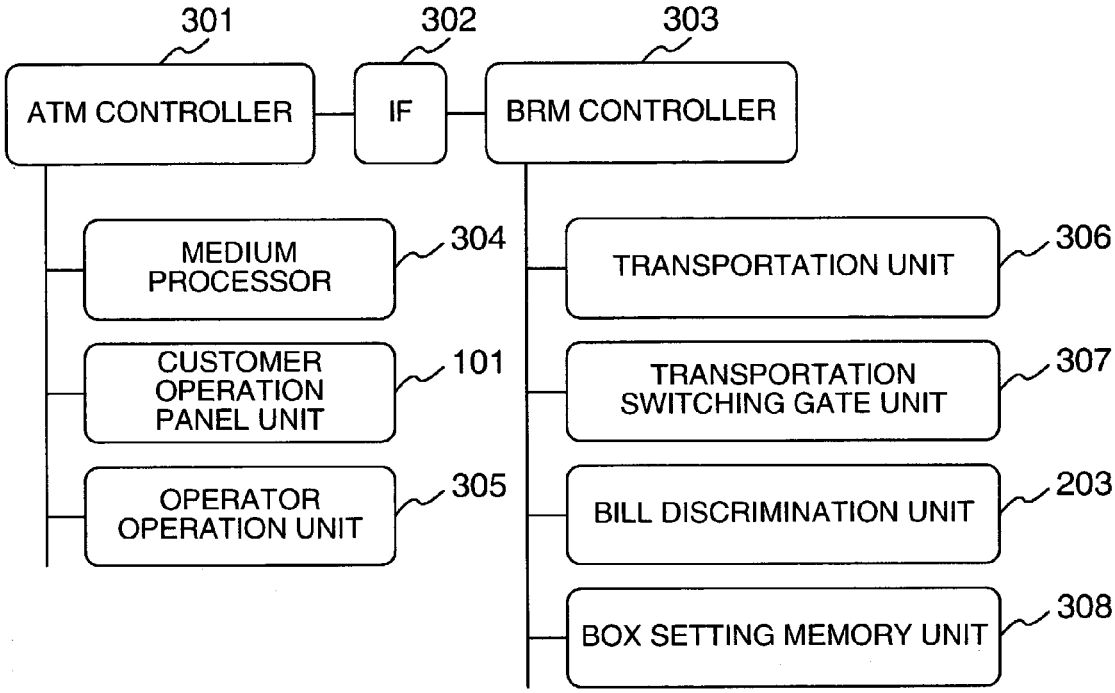
FIG. 3 is a control block diagram of the ATM.
FIG. 4 is a diagram showing an example of a box setting information table.

FIG. 3 is a block diagram showing the functional circuits of the ATM 100. The ATM 100 comprises the customer operation panel 101, a medium processor 304 connected to the medium slot 102 for processing a medium, an operator operation unit 305, and an ATM controller 301 that controls those components. The ATM controller 301 is connected to a BRM controller 303 of the BRM 200 via an IF (interface) 302. The BRM controller 303 controls the bill discrimination unit 203 that detects the authenticity of bills, a transportation unit 306 that transports bills, and a transportation switching gate unit 307 that switches the transportation of bills according to a transaction executed by the ATM controller 301 while monitoring the status of bills and units using a sensor not shown. The BRM controller 303 further comprises a box setting memory unit 308, in which information set up for the bill storage boxes installed on the frames is stored, to control the transportation of bills based on the information stored in the box setting memory unit 308. The information stored in the box setting memory unit 308 is sent also to the memory of the ATM controller 301 for controlling the whole ATM 100. The box setting memory unit 308 is required to be installed only in one of the ATM 100 and the BRM 200. It may be in the ATM 100 only, or may be part of the function of the ATM controller 301 or the BRM controller 303.

The following describes deposit processing and withdrawal processing executed by the BRM controller 303 of the BRM 200. When a deposit transaction is selected on the customer operation panel 101, the shutter of the deposit/withdrawal port 201 is opened. When bills are inserted into the deposit/withdrawal port 201, a mechanism such as a rubber-surrounded supply roller takes out bills, one at a time, and sends them to a transportation path 202. The transportation path 202, composed of belts, rollers, and so on, transports a bill by holding it and by moving and rotating the belts and the rollers with the actuators such as a drive motor and an electromagnetic solenoid. The bill discrimination unit 203 discriminates a bill transported on the transportation path 202. When a bill is determined by the bill discrimination unit 203 as inadequate for the transaction because, for example, the bill is forged or broken and its size is small, the gate is switched to return the bill (deposit rejected bill) to the deposit/withdrawal port 201. On the other hand, a bill determined as adequate for the transaction is stored in the temporary storage box 204. The amount of stored bills is displayed on the customer operation panel 101. When the operator presses the confirmation key to confirm the amount stored in the temporary storage box 204, the bills are taken out from the temporary storage box 204 and transported to the bill storage boxes 206 over the transportation path 202 via the bill discrimination unit 203. A bill determined by the bill discrimination unit 203 as inadequate for dispensing to the customer is treated as a deposit-storage-rejected bill. The transportation switching gate unit 307 switches the transport switching gates 205 to store the bill into the corresponding bill storage box 206 according to the validation result of the bill discrimination unit 203 (denomination such as a thousand yen bill or ten-thousand yen bill or deposit-storage-rejected bill) based on the information stored in the box setting memory unit 308.

On the other hand, when withdrawal processing is selected on the customer operation panel 101, a predetermined number of bills are taken out from the corresponding bill storage boxes 206 based on the information stored in the box setting memory unit 308 and are sent onto the transportation path 202. When a bill is determined by the bill discrimination unit 203 as inadequate for withdrawal (withdrawal-rejected bill) when the bill passes through the bill discrimination unit 203, the gate is switched to store the bill in the temporary storage box 204. A bill determined by the bill discrimination unit 203 as adequate is transported to the deposit/withdrawal port 201. After the predetermined number of bills are transported, the shutter of the deposit/withdrawal port 201 is opened. A withdrawal-rejected bill is taken out from the temporary storage box 204 and is stored in the corresponding bill storage box 206 based on the information stored in the box setting memory unit 308.

FIG. 4 shows a box setting information table 400, stored in the box setting memory unit 308, that contains information on the bill storage boxes 206. The box setting information table 400 contains the box type, denomination information, and operation information for each frame number. A frame number column 401 contains information on the position of the frame 207. The frame numbers are assigned sequentially to the frames from top to bottom beginning with the one nearest to the deposit/withdrawal port 201 that is above the frames. When the frame 207 is added or removed, the frame numbers are increased or decreased according to the change. A box type column 402 contains information on the type of the bill storage box 206. "Recycle" means a recycling box that is the bill storage box 206 into or from which bills can be stored or taken out, "Deposit" means a deposit-only box in which bills can only be stored, and "Withdrawal" means a withdrawal-only box from which bills can only be taken out. In addition to those boxes, there are also a load box (box type "Load") used to load stored bills into some other bill storage box 206, a collection box (box type "Collect") used to collect bills from some other bill storage box 206, and a reject box (box type "Reject") in which deposit-storage-rejected bills or withdrawal-rejected bills described above are stored. A denomination information column 403 contains information on the denomination of a bill stored in the bill storage box 206.

"ten-thousand yen" means that ten-thousand yen bills are stored, "thousand yen" means that thousand yen bills are stored, and "Reserved" means that bills are not stored. "ALL" means that not only ten-thousand yen bills and thousand yen bills but also a plurality of types of bills such as 5000 yen bills, 2000 yen bills, and 10 dollar bills are stored. For example, in the box setting information table 400 shown in FIG. 4, because genuine ten-thousand yen bills are stored in the bill storage box 206 inserted into frame 2 and genuine thousand yen bills are stored in the bill storage box 206 inserted into frame 3 respectively, bills other than genuine ten-thousand yen bills and genuine thousand yen bills, rejected bills, left-behind bills, 5000 yen bills, 2000 yen bills, 10 dollar bills and so on are stored in the deposit-only box corresponding to frame 1 whose denomination information is "ALL" and whose operation information is "RJ-A". An operation information column 404, which will be described later, contains information when the box type is "Recycle" or when the box type is "Deposit" and the denomination information is "ALL".

FIG. 5 shows. a condition table 500 indicating the relation among a box type 501, denomination information 502, and operation information 503. This condition table 500 is stored in the condition table storage unit not shown. The condition table storage unit may also be included in at least one of the ATM controller 301 and the BRM controller 303.

When the box type column 501 contains "Deposit", the denomination information column 502 contains either one type of bill, such as ten-thousand yen bill and thousand yen bill, or "ALL". When a bill type is entered, the operation information column 503 should be left blank; if entered, an error will result or entered data is treated as invalid. When "ALL" is entered into the denomination information column 502, "RJ-A", "RJ-B", or "RJ-C" is entered into the operation information column 503. "RJ-B" indicates that the box stores bills taken out from the bill storage box but rejected such as withdrawal-rejected bills and left-behind bills. "RJ-C" indicates that the box stores bills inserted by a customer into the deposit/withdrawal port 201 but rejected such as deposit-storage-rejected bills. "RJ-A" indicates that the box stores both bills stored in "RJ-C" and bills stored in "RJ-B". The classifications "RJ-B" and "RJ-C" are made according to the source of bills in the ATM 100 or BRM 200, for example, the bill storage box 206 and the deposit/withdrawal port 201. That is, a bill taken out from the bill storage box 206 but is rejected is stored in "RJ-B". On the other hand, a bill inserted into the deposit/withdrawal port 201 and deposited as a result of validation but is determined as inadequate for dispensing to the customer (deposit-storage-rejected bill) is stored in "RJ-C". Examples of this type of bill include a bill determined as genuine by the bill discrimination unit 203 but is damaged or foul, a bill that cannot be determined as non-genuine but is suspicious, and so on. Managing those bills separately is meaningful for accounting or counting because they must be treated separately for those purposes. In particular, if the genuineness of a bill is suspected, managing the bill separately from other bills has a crime-prevention effect because it prevents the bill from being distributed and makes it easy to track the bill. In some cases, non-genuine bills may be managed more rigidly by storing those bills determined by the bill discrimination unit 203 as non-genuine and those bills not determined as non-genuine but deemed suspicious into one deposit-only box and by storing those bills determined by the bill discrimination unit 203 as genuine but found damaged or foul and the withdrawal-rejected bills into another deposit-only box.

When the box type column 501 contains "Recycle", any combination of one type of bill such as ten-thousand yen bill and thousand yen bill in the denomination information column 502 and "Deposit/Withdrawal", "Deposit-only", or "Withdrawal-only" in the operation information column 503 is allowed. "Deposit/Withdrawal" is operation information indicating that bills are stored into, and taken out from, the recycling box, "Deposit-only" is operation information indicating that bills are only stored into the recycling box, and "Withdrawal-only" is operation information indicating that bills are only taken out from the box. It is also accepted that, when the box type is "Recycle" and the denomination information is "ALL", the operation information is set automatically to "Deposit-only".

When the box type column 501 contains "Withdrawal", one type of bill such as ten-thousand yen bill or thousand yen bill is entered into the denomination information column 502. In either case, the operation information column 503 should be left blank and any data, if entered, is treated as an error or invalid data.

As described above, the bill-usage condition of the bill handling machine may be changed by changing the setting of a recycling box from one setting to "Deposit/Withdrawal", "Deposit-only", or "Withdrawal-only" without having to exchange bill storage boxes. With "Reserved" in the denomination information column 502 of a deposit-only box, recycling box, and withdrawal-only box, a "Reserved" bill storage box 206 may be taken out of service, for example, when there are too many bill storage boxes. When "Reserved" is entered, no data need be entered into the operation information column 503 and any data, if entered, is treated as an error or invalid data.

FIG. 6 shows setting information 601–605 stored in the box memory 208 (A–E) in the bill storage box 206 inserted into frames 1–5. This information is sent from the ATM 100 or the BRM 200 to the bill storage box inserted in the frame 207. This information stays there even after the box is removed from the frame 207. Note that the box type information in the box memory 208 cannot be rewritten because it is unique to each box. Because this memory is provided for each bill storage box, the box type information, denomination information, and operation information may be shared, allowing the ATM controller 301 or the BRM controller 303 to check the consistency between the operation information in the box memory 208 and the operation information that has been set.

The configuration of the embodiment of the present invention has been described. Next, how to maintain the consistency between the bill storage box operation information stored in the box setting memory unit 308 and the operation information in the box memory 208 included in the bill storage boxes will be described as follows.

The consistency between the box setting memory unit 308 and the box memory 208 is maintained at one of the following three times. First, the consistency is maintained when the ATM 100 or the BRM 200 is turned on. Because there is a possibility that the setup of bill storage boxes 206 was changed while the power was turned off, the information stored in the box setting memory unit is checked and, at the same time, the consistency between the box setting memory unit 308 and the box memory 208 is maintained. Second, the consistency is maintained when the sensor, not shown, detects that the door of the ATM 100 is closed and then opened. Because there is a possibility that the setup of the bill storage boxes 206 was changed after the door was closed and before it was opened, the consistency between the box setting memory unit 308 and the box memory 208 is maintained and checked. Third, the consistency is maintained when the BRM 200 receives a deposit operation command or a withdrawal operation command from the ATM 100. Although there should be no problem if the consistency is maintained when the power is turned or the door is closed and then opened, the consistency between the box setting memory unit 308 and the box memory 208 is maintained and checked before each deposit or withdrawal operation considering that the consistency maintenance operation was not performed for some reason.

Figure 7:
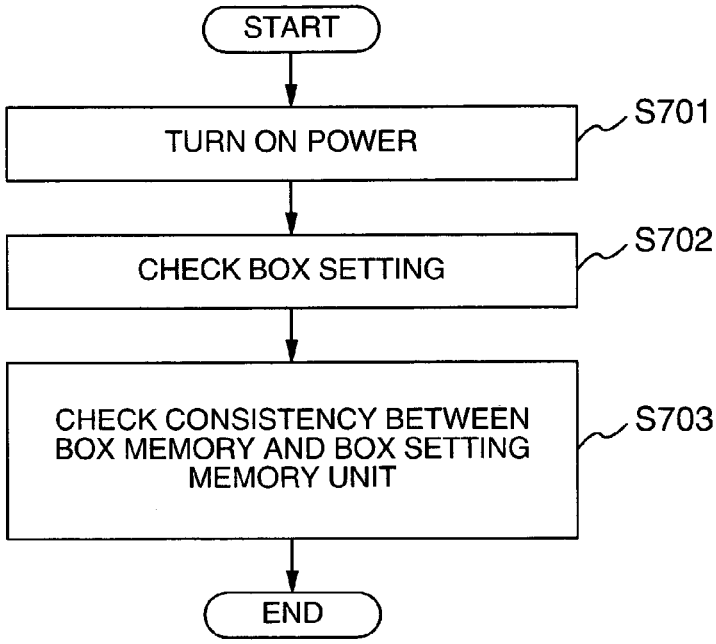

FIG. 7 is a flowchart showing the control operation executed by the ATM controller 301 when the ATM 100 or the BRM 200 is turned on. The operation of the flowchart shown in FIG. 7 is executed every time the ATM 100 is turned on. When the power is not turned on, the ATM controller 301 or the BRM controller 303 does not monitor the insertion and the removal of a bill storage box 206 into or from the frame 207. Therefore, the processing in FIG. 7 is required because a malfunction may occur if the ATM 100 or the BRM 200 is started without checking, confirmation, or investigation (hereinafter called checking) after the setting of the bill storage boxes 206 has been changed. The following describes the flowchart with reference to FIG. 7.

When the power is turned on (S701), the ATM controller 301 first checks the box setting information table 400 stored in the box setting memory unit 308 (S702). The detail will be described with reference to FIG. 9. The ATM controller 301 checks if the contents of the box setting information table 400 stored in the box setting memory unit 308 match the condition stored in the condition table according to the rule pre-stored in the ATM controller 301 or the BRM controller 303 so that the ATM 100 or the BRM 200 is able to execute the deposit or withdrawal operation properly. Next, the ATM controller 301 checks if the setting information in the box memory 208 matches that in the box setting memory unit 308 (S703). The detail will be described with reference to FIG. 10.

Figure 9:
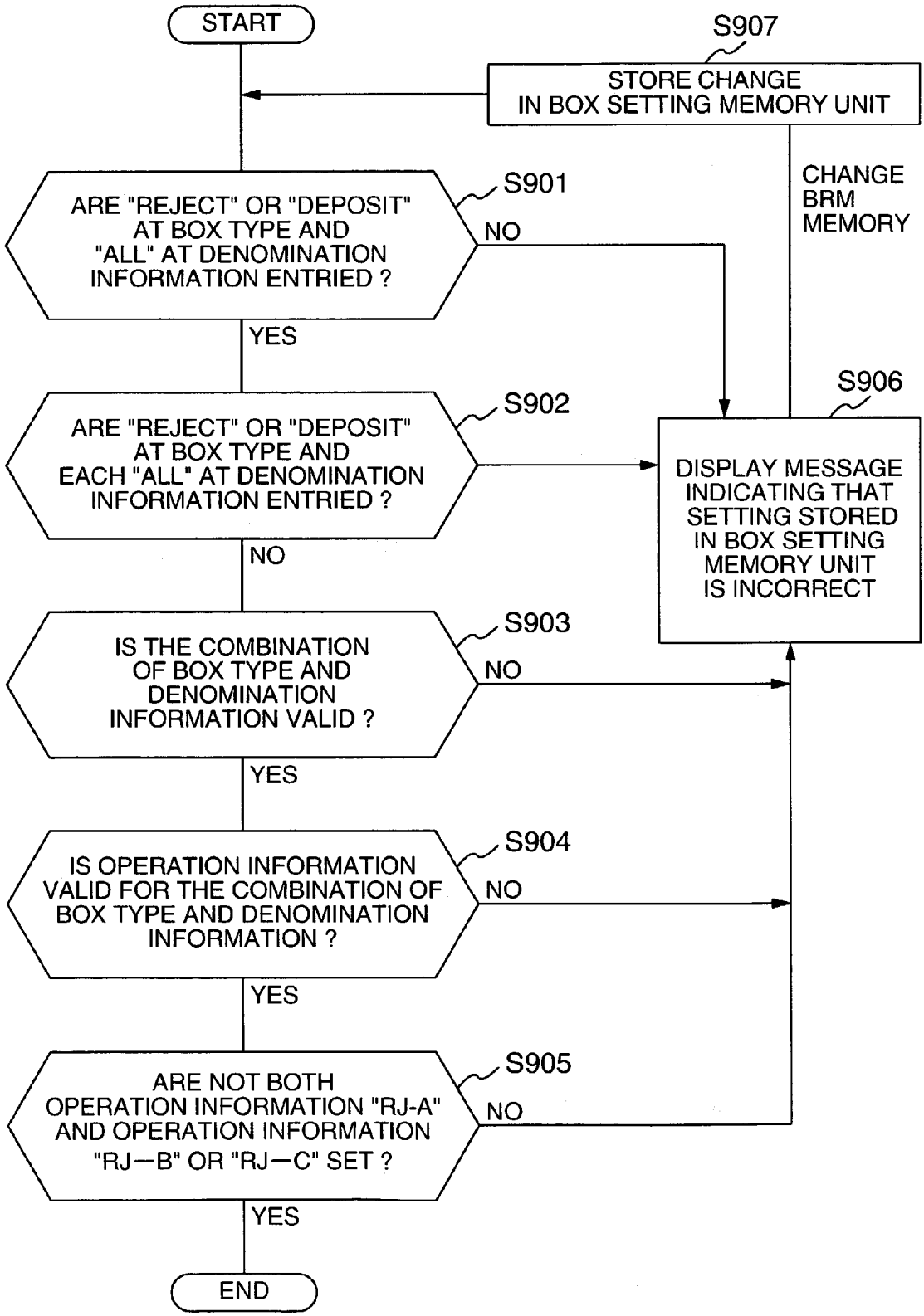
FIG. 9 is a flowchart showing the box setting check operation.

FIG. 9 is a detailed flowchart showing the box setting checking operation executed in step S702 and in step S1008 that will be described later. The following describes the steps in FIG. 9. The control operation shown in the flowcharts in FIGS. 9 and 10 may be executed by the ATM controller 301, BRM controller 303, or both that works together. First, the controller references the box setting information table 400 in the box setting memory unit 308 to check if the table contains an entry whose box type is "Reject" or an entry whose box type is "Deposit" and whose denomination is "ALL" (S901). Because, before the ATM 100 or BRM 200 is put into operation, a bill storage box 206 in which rejected bills are to be stored must be installed. If there is no such entry, a screen is displayed on the operator operation unit 305 to display a message indicating that the setting of the deposit-only boxes is inadequate as well as the corrective action (S906). If the result of step S901 is Yes, the controller references the box setting information table 400 to check if the table contains both an entry whose box type is "Reject" and an entry whose box type is "Deposit" and whose denomination is "ALL" (S902). This is because, if there are a plurality of bill storage boxes 206 set up as the storage box of one type of rejected bill (for example, a withdrawal-rejected bill), the BRM controller 303 cannot determine where to send the rejected bill. If the result of step S902 is No, a screen is displayed on the operator operation unit 305 to display a message indicating that the setting of the deposit-only box is inadequate as well as the corrective action (S906). Next, the controller compares the condition table 500 in FIG. 5 included in the box setting memory unit 308 with the box setting information table 400 to check if the combination of the box type and the denomination information is valid (S903). If it is found that the combination is not valid, the message indicating the condition is displayed on the operator operation unit 305 and the setup screen is displayed to prompt the operator to take the corrective action (S906).

FIG. 11 shows an example of this setup screen on which the condition indicating that the denomination information is invalid for the box type is shown (see 1101). A setting information entry field 1102 contains the input areas for the box type, denomination information, and operation information. The box type column, which contains unchangeable information, cannot be changed. In the row of frame 2, the denomination information "ALL" is specified for the box type "Recycle". Because this combination is not allowed in the condition table 500 in FIG. 5, the operator is requested to change it (see 1103). The operator touches a desired entry area to select a desired input area and selects desired information from the options displayed in the pull-down. The input method is not limited to the method described above but the operator may enter the information via the keyboard.

If it is found in step S903 that the combination of the box type and the denomination information is valid, the controller checks if the operation information is valid for the combination of the box type and the denomination information based on the condition table 500 in FIG. 5 (S904). If it is found that the operation information is not valid, a message indicating the condition is displayed and the operator is requested to correct the condition (S906). If the result of step S904 is Yes, the controller checks if "RJ-A" and one of "RJ-B" and "RJ-C" are specified (S905). This is because, if there are a plurality of bill storage boxes (for example, "RJ-A" and "RJ-B") set up as the storage box of one type of rejected bill as in step S902 (for example, a withdrawal-rejected bill), the BRM controller 303 cannot determine where to send the rejected bill. For the same reason, the controller checks if there are a plurality of frames 207 for which "RJ-A" is specified. If there are a plurality of such frames, a screen containing a message indicating that the setting of the deposit-only box is inadequate, as well as the corrective action, is displayed on the operator operation unit 305 (S906). When the operator selects in step S906 to change the contents of box setting memory unit 308 (BRM memory), the contents of the box setting memory unit 308 are updated according to the contents of the change (step S907). Setting the box setting information in the box setting memory unit 308 by referring to the condition table 500 as described above prevents an invalid setting for the normal operation of the ATM 100 or the BRM 200 from being specified.

Figure 10:
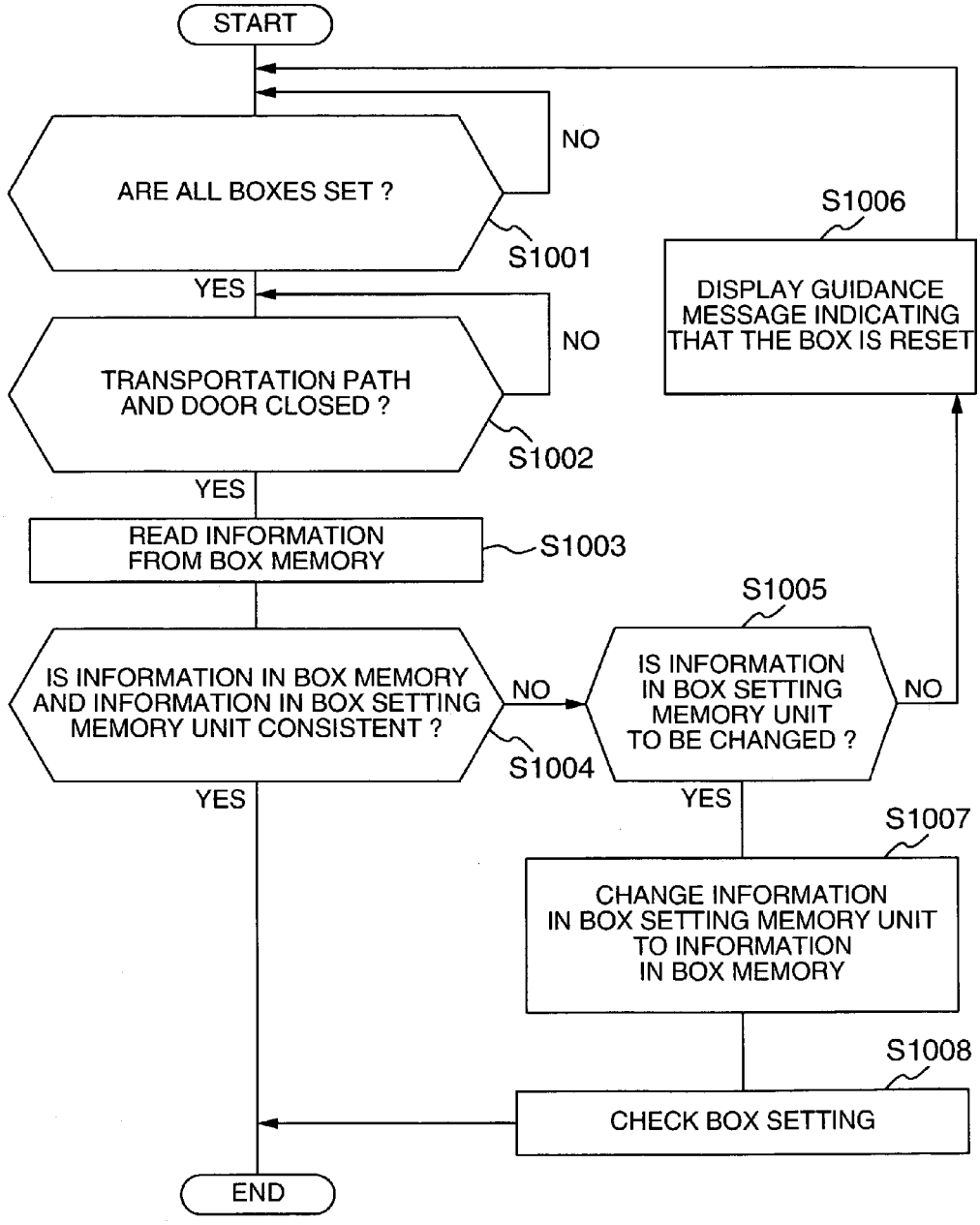
FIG. 10 is a flowchart showing the consistency checking operation.

FIG. 10 is a flowchart showing the operation in step S703 in which the ATM controller 301 checks if the information in the box memory 208 and the information in the box setting memory unit 308 are consistent. The operation of the flowchart shown in FIG. 10 is executed also when the sensor not shown detects that the door of the ATM 100 is closed with the power of the ATM 100 on. In the ATM 100 or the BRM 200, a plurality of boxes are removed when bills are replenished or collected, when boxes are exchanged in the BRM 200, when an action is taken for a problem caused in a box, or when an maintenance engineer makes a periodic inspection. In this embodiment where the bill storage boxes 206 are similar in shape for consistency, there is a risk of inserting an incorrect bill storage box 206 or inserting a bill storage box 206 into an incorrect position. In view of this, when a bill storage box 206 in which setting information is stored is inserted into the BRM 200 in which setting information is stored, the controller checks the consistency between the box setting memory unit 308 and the box memory 208 to prevent information stored in the ATM 100 or the BRM 200 from mismatching information stored in the box. The operation shown in FIG. 10 is sometimes called consistency checking operation. The following describes the steps in FIG. 10.

The sensors installed in the frames 207 check if the bill storage boxes 206 are set in all frames 207 for which denomination information (except "Reserved") is set in the box setting information table 400 in the box setting memory unit 308 (S1001). If the result of step S1001 is Yes, the sensor not shown checks if the door of the ATM 100 is closed (S1002). If the result of step S1002 is Yes, the box memory reader 209 in each frame 207 reads setting information from the box memory 208 (S1003). The controller compares the box type, denomination information, and operation information stored in the box memory 208 with the information in the box setting information table 400 in the box setting memory unit 308 for each frame number to check if they are consistent (if the information is inconsistent or consistent) (S1004). If the result of step S1004 is No (that is, the box memory 208 and box setting memory unit 308 are inconsistent), an option is provided to decide whether to change the contents (setting information) of the box setting memory unit 308 (S1005). Either this option may be displayed on the operator operation unit 305 during operation or whether to change the box setting memory unit 308 may be determined in advance. In the former case, the operator may decide which information is to use according to the condition: information in the storage of the inserted box memory 208 (change the contents of box setting memory unit 308) or the information stored in the ATM 100 or BRM 200 (do not change the contents of box setting memory unit 308). In the latter case, if it is decided, in advance, that the box setting memory unit 308 should not be changed, the operator cannot change the setting in the ATM 100 or the BRM 200 without permission.

Figure 12:
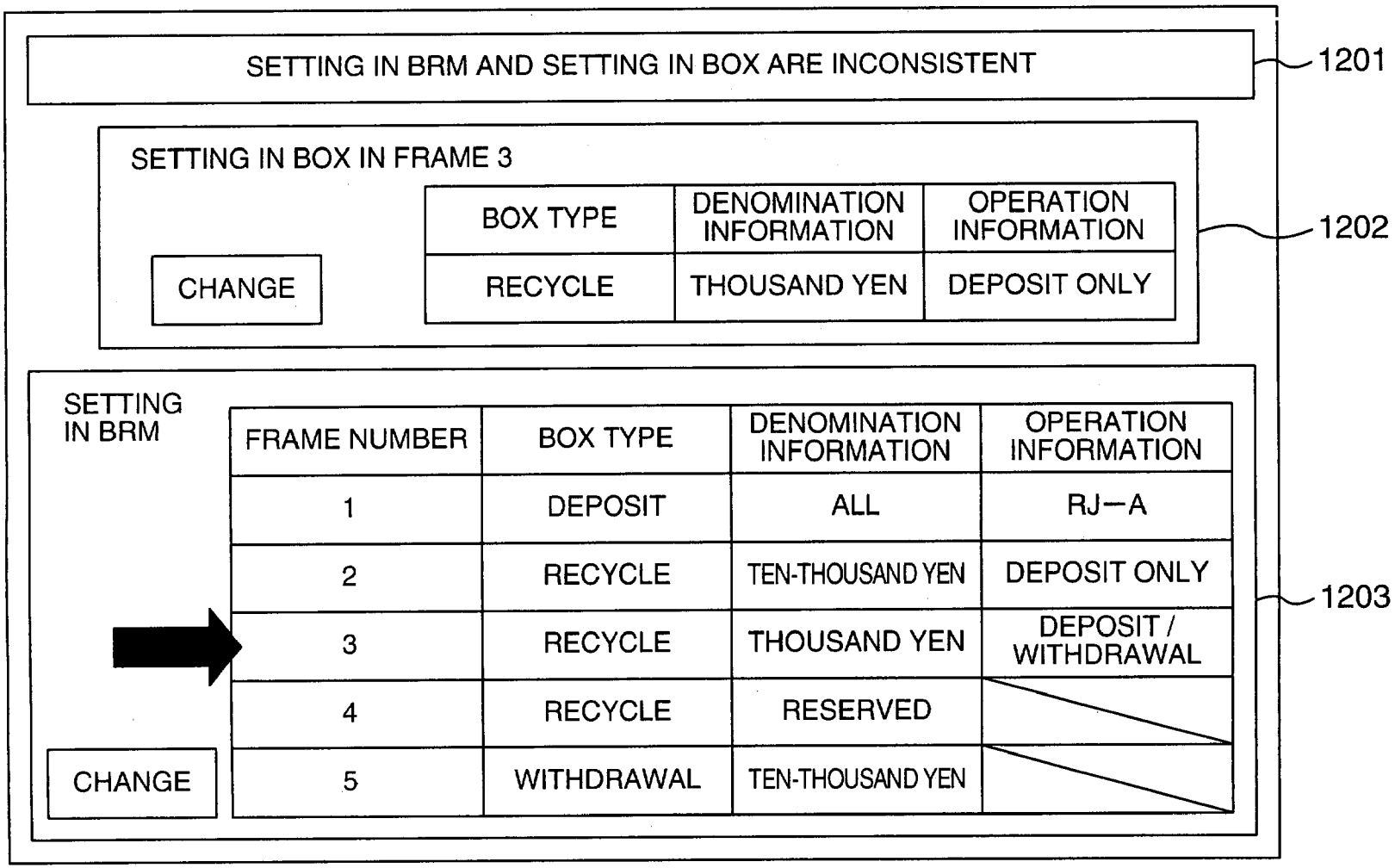
FIG. 12 is a diagram showing an example (2) of a screen displayed on an operator operation unit.

FIG. 12 is an example of the screen displayed on the operator operation unit 305 when operation information in the box memory 208 installed in frame "3" of the BRM 200 is not consistent with operation information in the box setting memory unit 308. The setting (see 1202) in the bill storage box 206 (box memory 208) and the setting (see 1203) in the BRM 200 (box setting memory unit 308) are displayed with a mark in the setting in the BRM 200 to indicate the frame 207 corresponding to the inconsistent setting. Although only the setting information on a frame 207 corresponding to the inconsistent setting information may be displayed in this case, the setting information on other frames 207, if displayed with the above information, could help the operator take action by referring to the setting information on other frames 207.

In the case shown in FIG. 12, the box type "Recycle", denomination information "thousand yen", and operation information "Deposit-Only" are stored in the box memory 208. On the other hand, in the box setting memory unit 308, the box type "Recycle" and denomination information "thousand yen" are stored but the operation information is "Deposit/Withdrawal" which is different from and inconsistent with the information in the box memory 208. If the BRM 200 or the ATM 100 is started in this state, a problem will arise. That is, no bill is stored in the bill storage box 206 for which the operation "Deposit-Only" is specified because bills are not supposed to be taken out therefrom. However, if "Deposit/Withdrawal" is specified in the BRM 200 (box setting memory unit 308), there is a possibility that the BRM controller 303 or the ATM controller 301 will send a withdrawal instruction to the bill storage box 206 based on that information. At that time, an error will result if no bill is stored in the bill storage box 206. In addition, because a bill storage box to be used as "Withdrawal-only" will not accept bills, the operator stores rather more bills in that box. However, if "Deposit/Withdrawal" is set in the ATM or BRM in this case, bills are stored in the bill storage box based on that information. As a result, the box will becomes full soon, the bill handling machine will stop the transaction, and a maintenance task such as the collection of bills will be required. Similarly, for a deposit-only box, if a deposit-only box for which "RJ-B" is set is inserted into a frame in which an "RJ-C" deposit-only box is to be inserted, rejected bills to be inserted into the "RJ-C" box will be stored into the "RJ-B" deposit-only box unless the consistency between the deposit-only box and the box setting memory unit 308 is established. That is, a bill inserted into the deposit/withdrawal port but is rejected is stored in the deposit-only box in which bills taken out from the bill storage box but are rejected are to be stored. This will create confusion when the operator collects rejected bills because he or she cannot identify where rejected bills came from and how many rejected bills are stored. To prevent this problem, the recycling box operation information (Deposit-Only, Withdrawal-only, Deposit/Withdrawal) is stored in the box memory 208 in the machine according to the present invention and, at the same time, the consistency between the box memory 208 of the bill storage box 206 inserted into the frame 207 and the box setting memory unit 308 is checked.

If the result of step S1005 in FIG. 10 is No, that is, if the setting in the box setting memory unit 308 is not changed, a guidance message is issued indicating that the box be reset (S1006). In this case, the screen prompting the operator to change the setting in the box memory 208 may also be displayed at the same time. If the result of step S1005 is Yes, that is, the setting in the box setting memory unit 308 is changed, the information in the box memory 208 is sent to the box setting memory unit 308 for updating (S1007). Giving priority to the information in the bill storage box 206 in this way allows the ATM 100 or the BRM 200 to be used based on the information stored in the bill storage box 206 inserted by the operator. In an actual operation, the box memory 208 is rarely changed. This is because the bill storage box 206 to be inserted into the frame 207 has bills already stored by the operator according to the operation of the bill storage box 206. Giving priority to the information in the bill storage box 206 is efficient in that the operator can use the bill storage box 206 having bills already stored therein.

A supplementary description of step S1005 and step S1007 will be given below. When the ATM 100 or the BRM 200 is ready for use in the configuration in which a plurality of bill storage boxes 206 have been set (where "ready for use" means that an application is available), it is possible to change the setting in the box setting memory unit 308 and doing so is efficient. However, if the ATM 100 or the BRM 200 is not ready for use, a denomination not consistent with the existing applications cannot be used. In that case, the boxes must be reset. For example, if a 2000 yen box is inserted when an application supports only ten-thousand yen and thousand yen bills, only "ten-thousand yen" and "thousand yen" are displayed on the customer's operation panel. In this case, a 2000 yen box cannot be used and another ten-thousand yen box or thousand yen box must be inserted. However, if an application consistent also with a 2000 yen bill is available, a 2000 yen box may be inserted and the operation may be executed by changing the box setting information. Thus, the setting of the boxes is usually changed according to an application that is consistent with the bills in use. The reason why priority is given to the information in the box memory is to enable the denomination information to be changed easily even when an improper denomination must be used or even when an improper-denomination box has been inserted mistakenly. For example, assume that an ATM booth is installed outdoors and that a maintenance engineer has mistakenly brought with him a bill storage box 206 containing an improper denomination. Even in this case, the bill storage box 206 may be used on the ATM 100 or the BRM 200 by inserting the bill storage box 206 and then changing the denomination information in the box setting memory unit 308. When the proper bill storage box 206 becomes available for the operation later, the ATM 100 or the BRM 200 may be used efficiently by exchanging the boxes and then changing the denomination information in the box setting memory unit 308.

The result of step S1007 may be predetermined to be Yes, in which case the information in the box setting memory unit 308 is always overwritten by the information in the box memory 208. This has the following effect. For example, this method is used when those not familiar with the operation of the ATM 100 or the BRM 200, such as guards or security company's personnel, replenish the ATM 100 or the BRM 200 with money before the operation is started or after the operation is ended. In this case, the information in the box setting memory unit 308 is automatically overwritten by the information in the box memory 208 with no manual invention. Even in this case, the ATM must have an application installed that can process every possible denomination.

When the information in the box setting memory unit 308 is changed in step S1007, the box setting checking operation shown in FIG. 9 is executed (S1008). When the setting in the box setting memory unit 308 is changed during this box setting checking operation, the ATM 100 should be turned off and then the turned on to execute the operation of the flowchart shown in FIG. 7 to establish the consistency between the information in the box setting memory unit and the information in the box memory.

Figure 8:
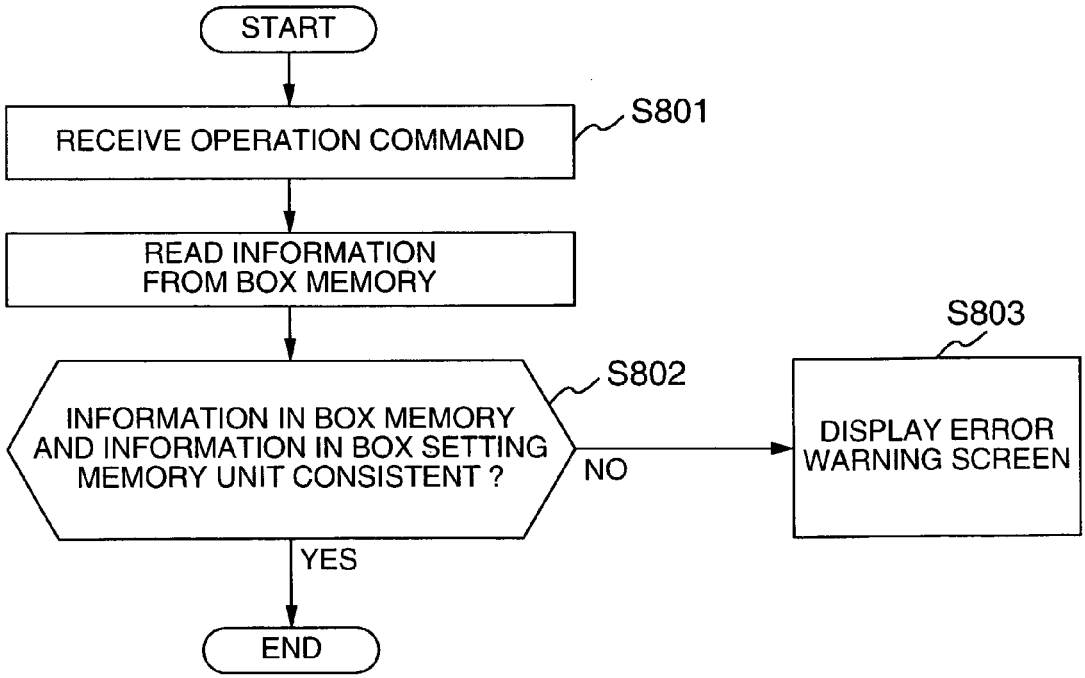
FIG. 8 is a flowchart showing the control operation executed by a BRM controller when it receives an operation command.

FIG. 8 is a flowchart showing the control operation executed by the BRM controller 303 to check the bill storage boxes 206 before the ATM 100 or the BRM 200 executes the deposit or withdrawal operation. The operation of the flowchart in FIG. 8 is executed before every deposit or withdrawal operation. The ATM controller 301 regularly monitors the status of the BRM 200 (at an interval of several seconds). However, the monitoring of the BRM 200 is sometimes not performed, for example, when the monitoring period is too long, when non-monitoring processing (reading data from a large recording medium) is performed, or when priority is given to the processing of other units. If the bill storage box 206 is changed while the BRM is not monitored, the change is not reflected on the box setting memory unit 308. In this case, the information in the box memory 208 of the bill storage box 206 installed in the frame 207 may not be consistent with the information in the box setting memory unit 308. To prevent this, the controller checks the bill storage boxes 206 before a deposit or withdrawal transaction is performed. The following describes the steps in FIG. 8.

In response to a deposit or withdrawal operation command from the ATM controller 301 via the IF 302 (S801), the BRM controller reads via the box memory reader 209 the information in the box memory 208 provided in each frame 207.

The controller checks the consistency between the information in the box memory 208 that has been read and the information in the box setting memory unit 308 (S802) and, if they are consistent, executes the deposit or withdrawal operation corresponding to the received operation command. If the box memory 208 and the box setting memory unit 308 are not consistent, the controller displays an error message on the screen of the operator operation unit 305 (S803). Providing a memory in each recycling box in the machine according to the present invention allows the controller to check the consistency between the operation information in each memory and the operation information that is set. At the same time, this allows the ATM or the BRM and the bill storage box to share the same box type information, denomination information, and operation information. Consistency is checked when the ATM or the BRM is turned on, when the sensor not shown detects that the door of the ATM is closed and then opened, or when the BRM receives a deposit or withdrawal operation command from the ATM. This reduces the risk of a problem that would be caused by a mismatch in the operation information. When it is found that the information is not consistent, which information is to be prioritized may be selected; information in the box setting memory. unit or information in the box memory. Those steps prevent an operator's unintentional operation that would be executed when a recycling box or a deposit-only box is set mistakenly and allows the operator to select an action to be taken next.

It is to be understood that this embodiment is one of embodiments of the present invention and that any modification may be made thereto without departing from the spirit of the invention. For example, bills of different countries may be handled and the steps in the flowcharts may be changed.

The present invention allows the bill handling machine and the bill storage boxes to share the same box type information, denomination information, and operation information, thus reducing the risk of a problem that would be generated by a mismatch in the operation information.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A bill handling machine having a deposit/withdrawal port via which bills are deposited and withdrawn, a transport path along which bills are transported, a discrimination unit that discriminates bills, and a plurality of bill storage boxes in which bills are stored, wherein each of the plurality of bill storage boxes comprises a recycle box configured to store a bill and withdraw a deposited and stored bill, the bill handling machine comprising:

a box setting memory unit configured to store first operation information indicating whether a bill in the recycle box is recycled;

a box memory included in the recycle box configured to store second operation information indicating whether a bill in the recycle box is recycled; and a controller that executes a consistency checking operation to check if the first operation information is consistent with the second operation information.

2. A bill handling machine having a deposit/withdrawal port via which bills are deposited and withdrawn, a transport path along which bills are transported, a discrimination unit that discriminates bills, and a plurality of bill storage boxes in which bills are stored, comprising:

a box setting memory unit in which operation information on the bill storage boxes is stored;

a box memory included in each of the bill storage boxes to store operation information on the bill storage box; and a controller that executes a consistency checking operation to check if the operation information in the box setting memory unit is consistent with the operation information in the box memory;

wherein the controller executes the consistency checking operation when the bill handling machine is turned on.

3. A bill handling machine having a deposit/withdrawal port via which bills are deposited and withdrawn, a transport path along which bills are transported, a discrimination unit that discriminates bills, and a plurality of bill storage boxes in which bills are stored, comprising:

a box setting memory unit in which operation information on the bill storage boxes is stored;

a box memory included in each of the bill storage boxes to store operation information on the bill storage box;

a controller that executes a consistency checking operation to check if the operation information in the box setting memory unit is consistent with the operation information in the box memory;

a door; and a sensor that detects that the door is opened and closed, wherein the controller executes the consistency checking operation according to the detection made by the sensor.

4. A bill handling machine having a deposit/withdrawal port via which bills are deposited and withdrawn, a transport path along which bills are transported, a discrimination unit that discriminates bills, and a plurality of bill storage boxes in which bills are stored, comprising:

a box setting memory unit in which operation information on the bill storage boxes is stored;

a box memory included in each of the bill storage boxes to store operation information on the bill storage box; and a controller that executes a consistency checking operation to check if the operation information in the box setting memory unit is consistent with the operation information in the box memory;

wherein, when the bill handling machine executes a deposit operation or a withdrawal operation, the controller executes the consistency checking operation before the deposit operation or the withdrawal operation.

5. A bill handling machine having a deposit/withdrawal port via which bills are deposited and withdrawn, a transport path along which bills are transported, a discrimination unit that discriminates bills, and a plurality of bill storage boxes in which bills are stored, comprising:

a box setting memory unit in which operation information on the bill storage boxes is stored;

a box memory included in each of the bill storage boxes to store operation information on the bill storage box; and a controller that executes a consistency checking operation to check if the operation information in the box setting memory unit is consistent with the operation information in the box memory;

wherein, if the information in the box setting memory unit and the information in the box memory are inconsistent as a result of the consistency checking operation, the controller transfers the operation information from the box memory to the box setting memory unit to update the information therein.

6. A bill handling machine having a deposit/withdrawal port via which bills are deposited and withdrawn, a transport path along which bills are transported, a discrimination unit that discriminates bills, and a plurality of bill storage boxes in which bills are stored, comprising:

a box setting memory unit in which operation information on the bill storage boxes is stored;

a box memory included in each of the bill storage boxes to store operation information on the bill storage box;

a controller that executes a consistency checking operation to check if the operation information in the box setting memory unit is consistent with the operation information in the box memory; and an operator operation unit with a display unit;

wherein:

if the information stored in the box setting memory unit and the information stored in the box memory are different as a result of the consistency checking operation, the controller displays a screen on the operator operation unit, and the screen contains the information stored in the box setting memory unit and the information in the box memory and a guidance indicator guiding an operator to select whether to change the information in the box setting memory unit.

7. A bill handling machine having a deposit/withdrawal port via which bills are deposited and withdrawn, a transport path along which bills are transported, a discrimination unit that discriminates bills, and a plurality of bill storage boxes in which bills are stored, comprising:

a box setting memory unit in which operation information on the bill storage boxes is stored;

a box memory included in each of the bill storage boxes to store operation information on the bill storage box; and a controller that executes a consistency checking operation to check if the operation information in the box setting memory unit is consistent with the operation information in the box memory;

wherein the bill storage boxes include at least one recycle box that stores bills therein and dispenses the stored bills therefrom, and wherein the operation information includes information indicating whether the recycle box is to be used for deposit/withdrawal, deposit-only, or withdrawal-only.

8. A bill handling machine having a deposit/withdrawal port via which bills are deposited and withdrawn, a transport path along which bills are transported, a discrimination unit that discriminates bills, and a plurality of bill storage boxes in which bills are stored, comprising:

a box setting memory unit in which operation information on the bill storage boxes is stored;

a box memory included in each of the bill storage boxes to store operation information on the bill storage box; and a controller that executes a consistency checking operation to check if the operation information in the box setting memory unit is consistent with the operation information in the box memory;

wherein the operation information includes information indicating that bills taken out from a bill storage box and rejected by the discrimination unit are stored, or information indicating that bills inserted into the deposit/withdrawal port and rejected by the discrimination unit are stored.

9. A bill handling machine having a deposit/withdrawal port and a plurality of bill storage boxes in which bills are stored, comprising:

a box setting memory unit in which box type information indicating types of the bill storage boxes, denomination information indicating denominations of bills stored in the bill storage boxes, and operation information on the bill storage boxes are stored;

a condition table storage unit in which a condition table is stored, the condition table indicating a condition of combinations of the box type information indicating types of the bill storage boxes, the denomination information indicating denominations of bills stored in the bill storage boxes, and the operation information on the bill storage boxes; and a controller that determines if the information stored in the box setting memory unit is consistent with the information stored in the condition table.

10. The bill handling machine according to claim 9, wherein the condition table storage unit stores information indicating that a combination of Recycle or Withdrawal of the box type information and ALL designation of the denomination information is inhibited or invalid.

11. The bill handling machine according to claim 9, wherein the condition table storage unit stores a condition indicating that, when the denomination information is ALL, a combination of the denomination information and the operation information, which indicates that only bills inserted from the deposit/withdrawal port are stored or only bills taken out from the bill storage boxes are stored, is allowed.

12. The bill handling machine according to claim 9, wherein, the controller checks if the box setting memory unit contains either an entry whose box type is Reject or an entry whose box type is Deposit and whose denomination information is ALL.

13. The bill handling machine according to claim 9, wherein the controller first checks if a combination of the box types and the denomination information is valid and then checks if the operation information is valid for the combination of the box types and the denomination information.

14. The bill handling machine according to claim 9, further comprising an operator operation unit with a display unit, wherein, if it is determined that the information stored in the box setting memory unit is not consistent with the condition in the condition table, the controller issues a message and, at the same time, displays a screen containing the information stored in the box setting memory unit on the operator operation unit.

15. A bill handling machine comprising:

a deposit/withdrawal port that accepts and ejects bills from and to a customer;

bill storage boxes that stores bills therein;

a bill transportation path along which bills are transported between the deposit/withdrawal port and the bill storage boxes;

a box memory provided in each of the bill storage boxes to store denomination information or operation information on the bill storage box;

a plurality of frames on which the bill storage boxes are installed;

a box memory reader provided for each bill storage box to read denomination information or operation information from the box memory of each of the bill storage boxes installed on the frames; and a controller that controls the bill transportation path by using the denomination information or the operation information read by the box memory reader.

16. The bill handling machine according to claim 15, wherein the denomination information includes information on the denominations of bills stored in the bill storage boxes, and wherein, the operation information, when the bill storage box is a recycle box, includes information whether the box is to be used for deposit/withdrawal, deposit-only, or withdrawal-only and, when the bill storage box is a deposit box, includes information that classifies bills according to where the bills come from.

17. The bill handling machine according to claim 15, further comprising:

a box setting memory unit that stores information set up for the bill storage boxes installed on the frames, wherein, when the information stored in the box setting memory unit is updated by the information stored in the box memory, the controller checks box setting if the bill handling machine can execute a deposit operation or a withdrawal operation.

* * * * *